United States Patent [19]

Zangari et al.

[11] 4,295,436

[45] Oct. 20, 1981

[54] CAP LINING MACHINE

[75] Inventors: Dominic V. Zangari, 6 Drew La., Hightstown, N.J. 08529; Douglas R. Cranston, East Brunswick, N.J.

[73] Assignee: Dominic V. Zangari, Hightstown, N.J.

[21] Appl. No.: 39,220

[22] Filed: May 15, 1979

[51] Int. Cl.[3] ..... B21D 51/46

[52] U.S. Cl. ..... 113/80 D; 83/123

[58] Field of Search ..... 113/80 D, 80 DA; 83/126, 125, 123, 127, 128, 566; 425/809

[56] References Cited

U.S. PATENT DOCUMENTS

| | | | |
|---|---|---|---|
| 1,809,341 | 6/1931 | Jensen . | |
| 1,899,783 | 2/1933 | Warth . | |
| 1,908,898 | 5/1933 | Johnson . | |
| 2,216,750 | 10/1940 | O'Brien . | |
| 2,471,255 | 5/1949 | Weisenberg | 113/80 D X |
| 2,484,095 | 10/1949 | Johnson . | |
| 2,567,094 | 9/1951 | Belada | 113/80 D |
| 2,674,311 | 4/1954 | Griswold | 83/126 X |
| 2,699,197 | 1/1957 | McLaughlin, Jr. . | |
| 2,999,531 | 9/1961 | Acton . | |
| 3,015,843 | 1/1962 | Gora | 425/809 X |
| 3,328,873 | 7/1967 | Schweers . | |
| 3,363,305 | 1/1968 | Botkin . | |
| 3,959,061 | 5/1976 | Renck et al. . | |

*Primary Examiner*—Mark Rosenbaum

*Attorney, Agent, or Firm*—Richard C. Woodbridge

[57] ABSTRACT

A cap lining machine includes a circular score cutter and an anvil to produce cap liners in a rapid and dust free manner. The machine is fed by two streams of caps. The first stream is a conventional gravity feed. The second stream indexes a cap into position with a worm screw. The two stream feed mechanism inputs two caps simultaneously to a rotatable plate having receiving pockets therein. The plate presents the caps to the score cutter/anvil cutting station. After the cap liners are formed they are inserted into the cap by a pusher element. The pusher includes an override spring to prevent damage to inverted caps. In order to further minimize dust the web of liner material is cut only after twelve liners have been cut. Critical portions of the machine are enclosed in a dust-free housing. Moving parts are automatically lubricated by a pump mechanism. The machine is able to produce and insert cap liners at a very high rate of speed and in a reliable and dust-free manner.

11 Claims, 26 Drawing Figures

CAP LINING MACHINE

BACKGROUND OF THE INVENTION

1. Field of the Invention

This invention relates to a machine for cutting and inserting liners into caps.

2. Description of the Prior Art

There are a variety of cap liner machines known to those of ordinary skill in the art. For example, U.S. Pat. No. 3,015,843 discloses a cap lining apparatus including a die 65 for cutting slugs 34 from a blank 41 in cooperation with an anvil head 64. The cutting die 65 includes a tapered head section which cooperates with an ejector pin 75 to transfer the slug 34 from the die member 65 into a cap C. The die also includes a piston mechanism 64E which apparently serves to keep the slug 34 from sticking to the anvil 64 after the slug 34 has been cut by die 65. The device appears to be restricted towards metal caps only in which the slug is cut from a heated plastic strip. Such caps are believed to be well known in the soda pop bottle industry. A plunger subsequently comes down and causes the hot material to flow and form a seal. While such a device might be practical in the context of the older, well developed pop bottle art, it is doubtful if it would be effective with plastic caps and the unique requirements of the cosmetic industry.

Other references which might possibly be relevant include: U.S. Pat. No. 1,809,341; U.S. Pat. No. 2,471,255; U.S. Pat. No. 2,567,094; U.S. Pat. No. 2,699,197; U.S. Pat. No. 2,999,531; and U.S. Pat. No. 3,328,873.

SUMMARY OF THE INVENTION

Briefly described the invention comprises a cap lining machine specifically adapted for high speed lining of plastic caps. Unlined plastic caps are fed to a star wheel in two streams. The first stream is fed by gravity into a first pocket on a star wheel. The second stream is positively fed by a constantly rotating screw into a second pocket on the star wheel. The second positive feed is necessary to prevent jamming of the star wheel and it also assists in increasing the speed of the apparatus. The star wheel indexes two caps at a time into position under a web of cap lining material. The liner cutting apparatus comprises a stationary tapered score cutter, a movable hollow anvil and a plunger mechanism for pushing the liner slugs home into the caps. The score cutter is located below the moving anvil and above the cap. In operation the hollow anvil moves downwardly forcing the liner web against the cutting edge of the score cutter thereby forming a correctly sized slug. A plunger then passes through the anvil section and pushes the slug home through a guide into the hollow interior of the cap. The plunger then withdraws and the machine then indexes the web and anothercap into position for the next insertion operation. The major moving parts of the machinery are driven off a single drive shaft. A six to one gear reducing mechanism is employed to drive a web cutter so that a web is cut after twelve slugs have been cut from it.

The unique arrangement of anvil and score cutter are such as to minimize the production of dust which previously had been a major problem in the cosmetic bottling industry. The cap feed mechanism is important because it allows the machine to operate at relatively high speeds with a minimum of jamming. Override features are incorporated into the cap screw feed section, the star wheel and the plunger mechanism in order to prevent damage to both the machine and the caps while running at high speed. The interior portions of the machine are totally enclosed to keep out dust. In addition, the invention includes a self-lubricating pump system to guarantee sufficient lubrication at all times.

These and other features of the invention will be more fully understood with reference to the following drawings and detailed description of the preferred embodiment.

DETAILED DESCRIPTION OF THE PREFERRED EMBODIMENT

During the course of this description like numbers will be used to illustrate like elements according to the different views which illustrate the invention.

Figure 1:
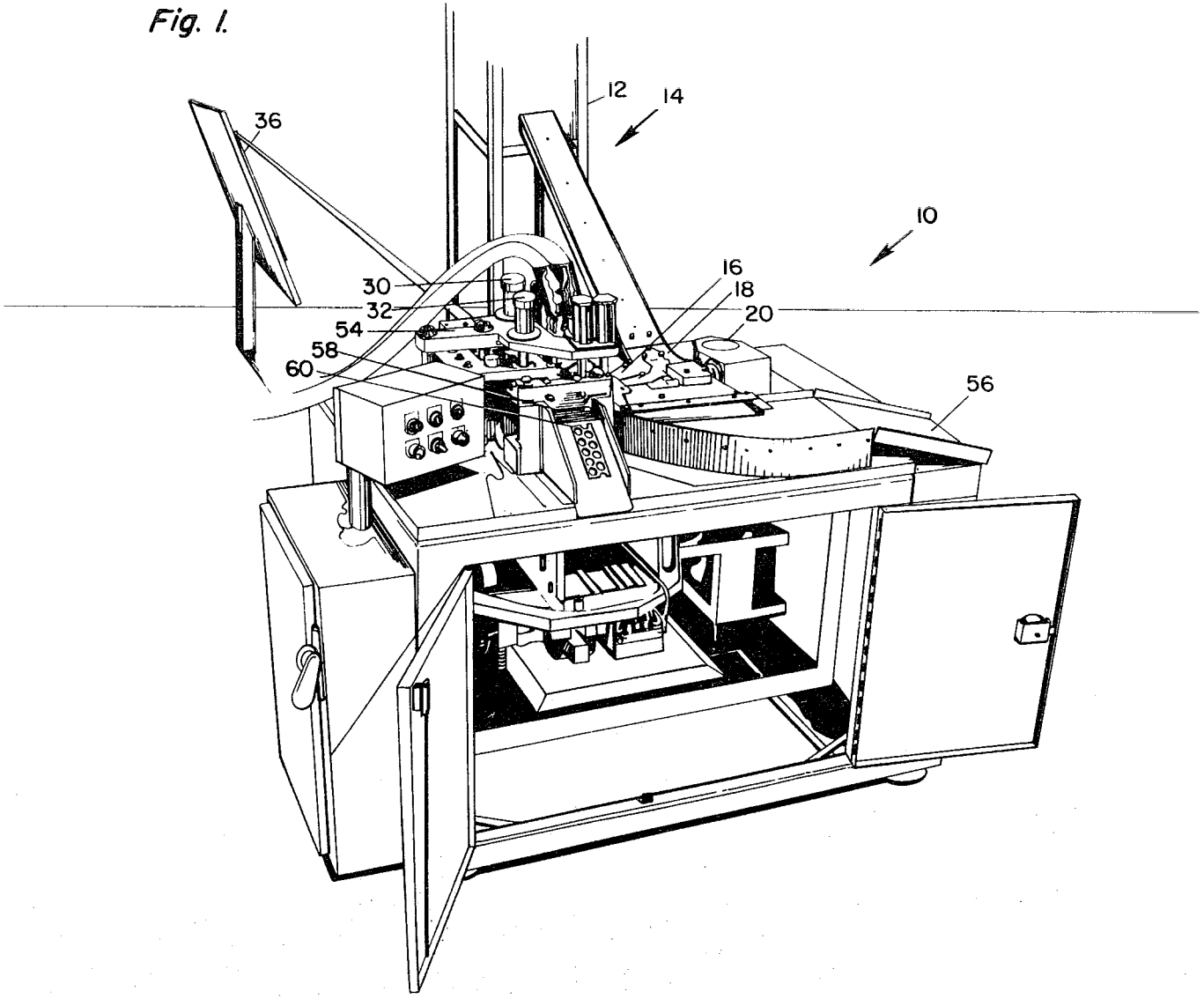
FIG. 1 is a perspective view of the invention according to the preferred embodiment thereof.

FIG. 1 is a perspective view of the preferred embodiment of the invention 10 showing its relationship to supporting equipment. A conventional cap supply mechanism 12 provides two streams of caps 14 to the machine 10. The first stream 16 is a standard gravity feed stream. The second stream 18 is provided under the influence of gravity to a positive cap feeding mechanism 20. Details of the positive cap feeding mechanism 20 will be explained subsequently. The conventional cap supply mechanism presents caps to the machine in a manner well known to those of ordinary skill in the art and accordingly, is not considered to be part of the present invention. Caps are normally presented upside down with the interior of the cap facing upward.

A star wheel 22 is located on the top of a machine 10 and is adapted to receive two caps at a time. A first cap 14 is received in a first star wheel pocket 24 from gravity feed stream 16. Similarly, a second star wheel pocket 26 receives another cap 14 from the second feed stream 18. The second pocket 26 is positively fed by a feed worm or cam 28 which is driven by cap feeding station mechanism 20. One of the important features of the machine is the ability to run at high speeds. Part of the high speed capability is provided by the lining of two caps at once. Accordingly, it is necessary to fill the two pockets 24 and 26 between indexing rotations of the star wheel 22. In order to perform that operation without jamming the machine it is necessary to positively place a cap 14 in the second pocket 26 before the star wheel 22 rotates. There are two reasons for this. Firstly, if pocket 26 were not filled positively, it might be possible for an additional cap 14 to jam part way into the first pocket 24 as the star wheel 22 indexes two cap positions at a time. Secondly, it is necessary to withhold a cap 14 from stream 18 from the first pocket until it is in position in front of stream 16. Otherwise, there is a possibility that a cap 14 might jam halfway into the first pocket as it indexes into position.

Continued indexing of the star wheel 22 presents a pair of caps 14 to a first and a second lining station 30 and 32 respectively. Prior to the lining operation a web of suitable cap lining material 34 is indexed into position above cap 14. The cap lining material 34 is presented to the machine 10 by a conventional web feed reel 36. The web feed reel 36 may be either positively driven or of passive variety. Such devices are well known to those of ordinary skill in the art and are not deemed to comprise part of the present invention.

The cap lining mechanisms 30 and 32 essentially comprise the following elements: A mounting bracket 38, housing 40, override spring 42, pusher rod 44, anvil mounting guide bracket 46, anvil 48, score cutter 50 and liner guide chute 52. The web of cap lining material 34 is indexed into position between anvil 48 and cutter 50 by web feed mechanism 54. Web feed reel 36 provides cap lining material 34 to the web feed mechanism 54. The purpose of web feed mechanism 54 is to present fresh cap lining material to the web cutting stations 30 and 32.

The operation of the cap lining and insertion stations 30 and 32 will be understood more fully by referring to FIGS. 2E–2I. Both liner cutting mechanisms 30 and 32 operate simultaneously to produce liners for caps which are located three pitch positions away. In other words, the caps 14 being lined are three star wheel pockets apart. The details of the operation of the liner cutting and insertion stations 30 and 32 will be described in more detail in a subsequent section of this disclosure.

Once the caps 14 have been lined the star wheel 22 indexes them to the appropriate discharge chute 56. The machine 10 includes a web cutting mechanism 58 that severs the web 34 after six complete lining cycles of the cutting mechanisms 30 and 32. Since the lining mechanisms 30 and 32 cut two liners simultaneously the severed web portion 60 will include twelve holes 62 where the plug has been cut. By not operating the web cutting mechanism 58 after each lining operation it is possible to reduce the dust generated by the machine 10 and produce a severed web portion 60 which is of manageable length.

Figure 2C:
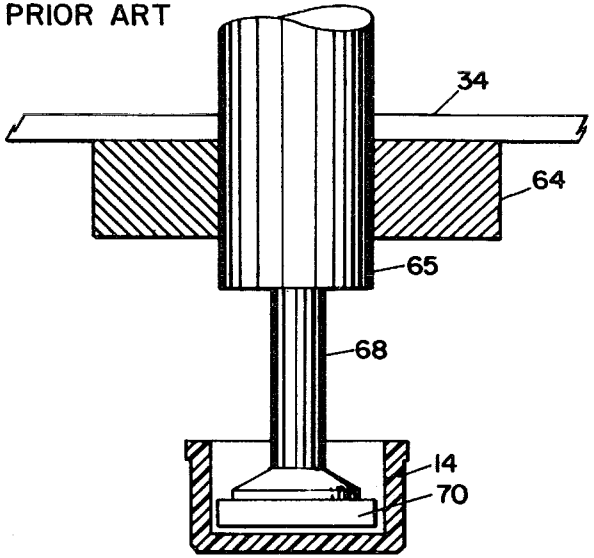
Fig. 2C. PRIOR ART
FIGS. 2A through 2C illustrate in a schematic manner the way in which a common prior art cap lining machine operates.
Figure 2D:
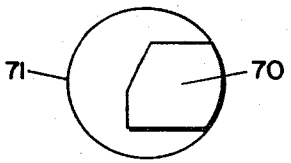
Fig. 2D. PRIOR ART
FIG. 2D illustrates in detail a cap liner provided by prior art steps 2A–2C above.
Figure 2A:
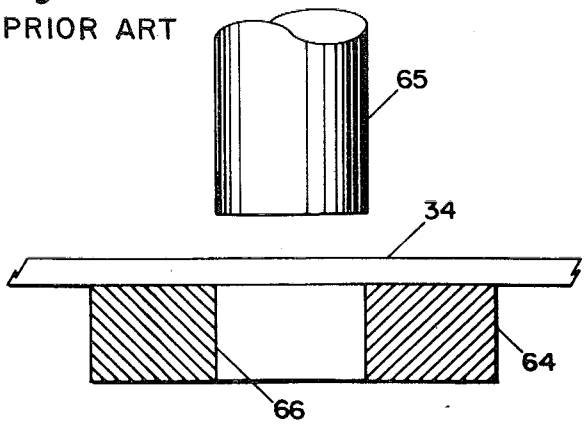
Fig. 2A. PRIOR ART
Figure 2B:
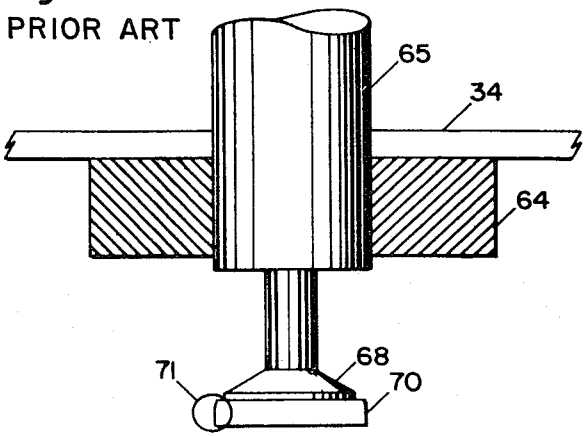
Fig. 2B PRIOR ART
Figure 2E:
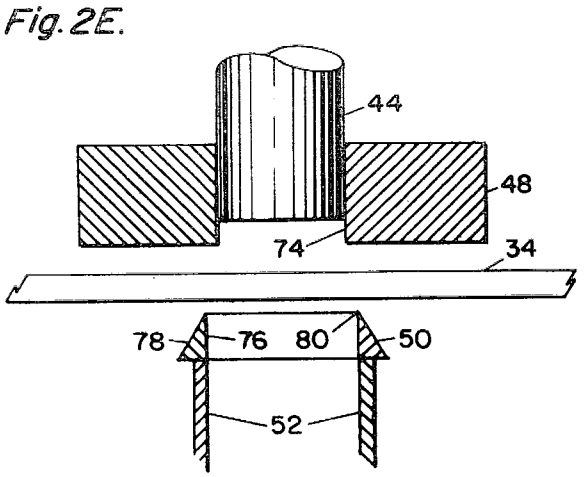
FIGS. 2E through 2H illustrate in a schematic fashion the manner in which the anvil and score cutter of the present invention cooperate to produce a cap liner.
Figure 2F:
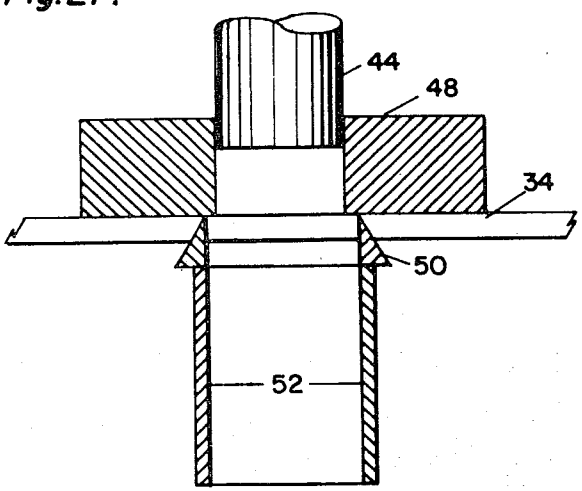
Figure 2G:
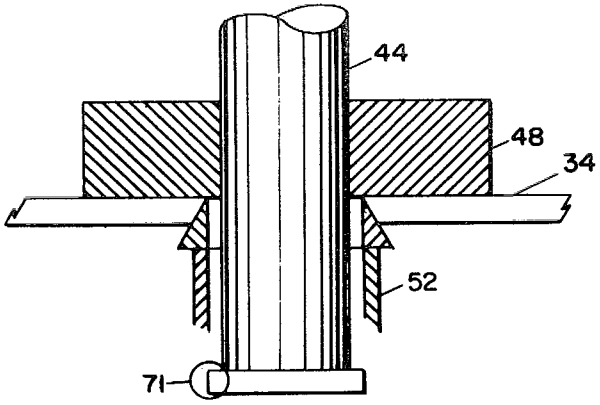

One of the major novel features of the invention resides in the special relationship between anvil 48 and score cutter 50. In order to appreciate the uniqueness of this arrangement it is desirable to first understand the techniques used by a typical prior art cap lining machine. Steps of a conventional prior art cap lining machine are illustrated in FIGS. 2A–2C. The prior art mechanism typically comprises a lower circular die 64 having a passageway 66 therethrough. A punch 65 having an outside diameter that is just slightly smaller than the diameter of passageway 66 is located above the die 64. At the beginning of the punching operation a section of fresh web 34 is indexed into position above die 64 and below punch 65 as shown in FIG. 2A. The punch 65 is then driven downwardly into passageway 66 as shown in FIG. 2B. In doing so it produces a liner plug 70 by the shearing action between the die 64 and punch 65. The shearing action produces a raggedly cut plug 70 having fibrous ends as shown in detail 2D. Dust is a major problem in the cosmetic packaging field, for example, in the bottling of shampoos and the like. The dust is not only visible, but it can contribute to machine failures. FIG. 2C illustrates the step by which the pusher rod 68 places a liner 70 into an upside down cap 14.

The dust problem is exacerbated as the punch 65 withdraws from passageway 66. During that operation the punch 65 disturbs the rim of the web 34 and creates more dust by tearing and shearing additional fibers from lining material 34.

An additional problem related to the prior art technique of FIGS. 2A–2D concerns the alignment of the punch 65 with the die 64. If the center line of passageway 66 is not exactly coaxial with the center line of punch 65 then the punch 65 will cause the passageway 66 to wear more on one side than the other. This in turn causes the punch 65 to wear excessively on one side too. Because the wear on both the die 64 and punch 65 is uneven when they are eccentrically aligned, it is not possible to effectively regrind those two elements in order to restore them to their previous tolerances. Therefore a minor misalignment of the punch 65 and die 64 may make it necessary to destroy those tools.

Figure 6:
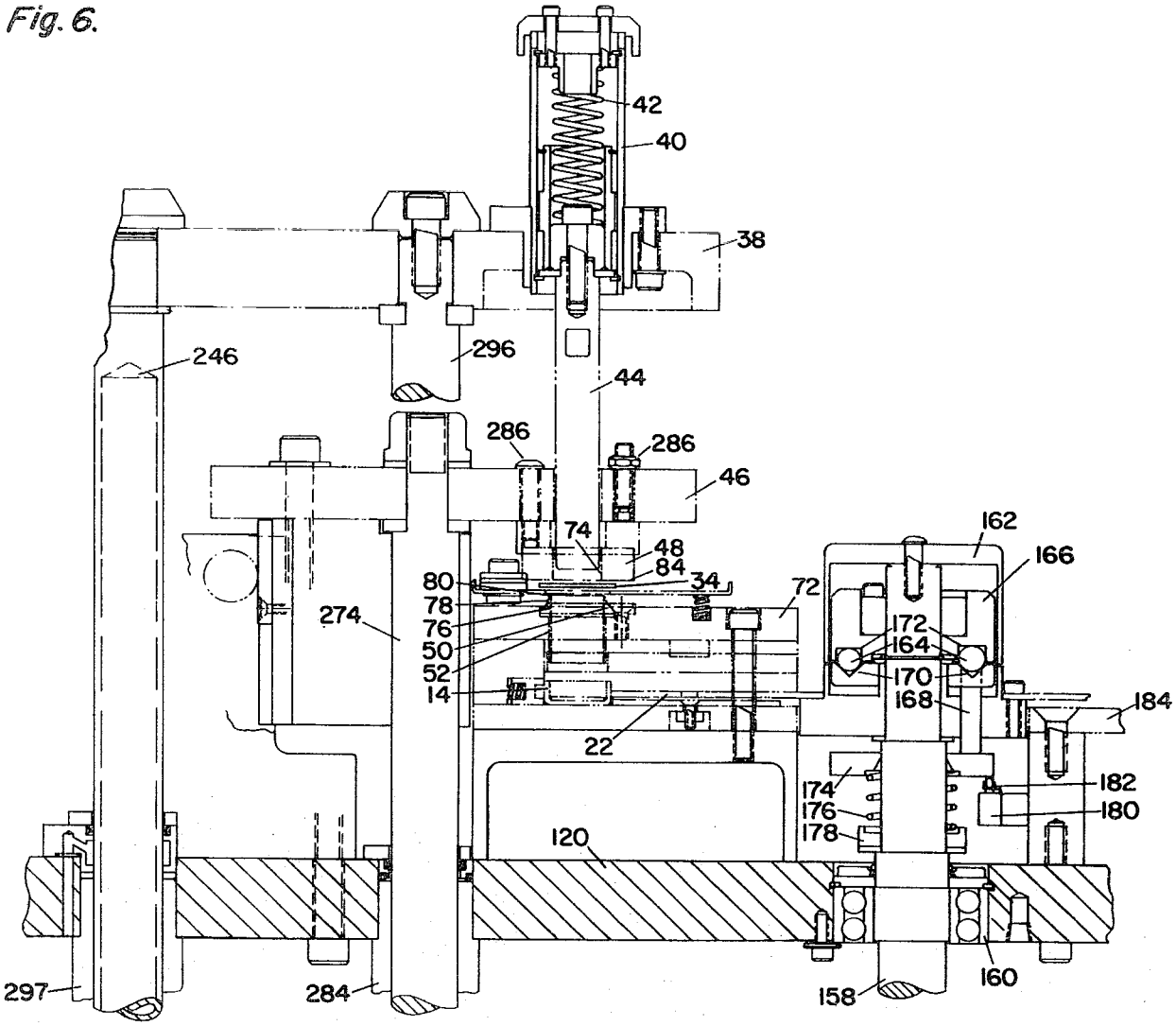
FIG. 6 is a partial, cut-away front elevational view of the score cutter and override mechanisms.

The liner cutting operation according to the present invention is illustrated schematically in FIGS. 2E–2I. The score cutter 50 is rigidly received in a bracket 72, shown in FIG. 6, which is mounted to the surface of the machine 10. The score cutter 50 does not move at any time during the operation of the machine. A round, donut shaped anvil 48 is connected to reciprocating bracket 46. Anvil 48 includes an interior passageway 74 which allows pusher rod 44 to pass through. Both anvil 48 and pusher 44 reciprocate with respect to cutter 50. Cutter 50 includes an interior cylindrical passageway 76 and a tapered exterior rim 78 which leads up to a circular cutting edge or rim 80.

In operation a cap 14 is indexed into position under guide chute 52. Simultaneously a new portion of web liner 34 is indexed into position under anvil 48 and above cutter 50. See FIG. 2E. The anvil 48 then moves downwardly so as to force the cutting material 34 against cutting edge 80 thereby forming a cap liner plug 82. See FIG. 2F. The inside diameter of passageway 76 is larger than the inside diameter of passageway 74 and accordingly, the cutting edge 80 will always match up against a portion of land surface 84 on the face of anvil 48. The cutting of the liner plug 82 according to this method is more akin to a "pinching" or "cutting" action as opposed to the "shearing" action associated with the technique shown in FIGS. 2A–2D. See FIG. 2G. Therefore, the edge of the cap liner is cleaner, as shown in the close-up of FIG. 2I and less dust is generated.

Figure 2H:
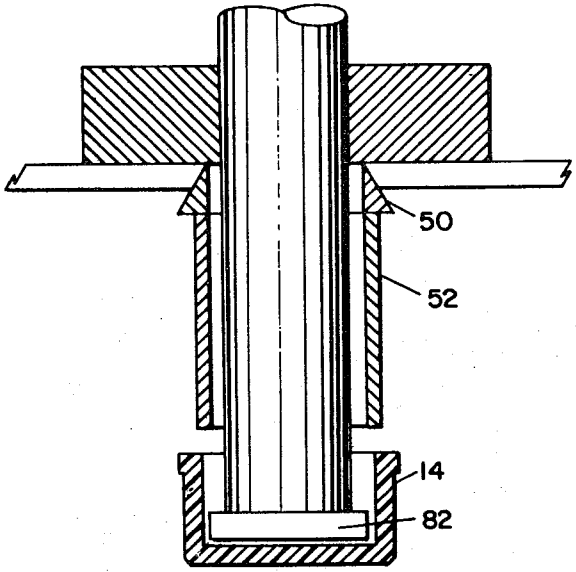
Figure 2I:
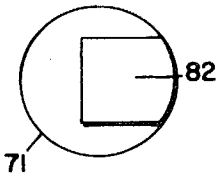
FIG. 2I illustrates in detail a cap liner produced by steps 2E–2H above.
Figure 4:
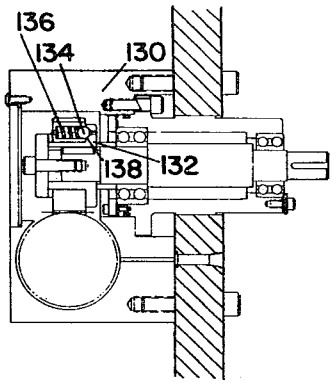
FIG. 4 is a partial cut-away side elevational view of the cap feed mechanism.

After the plug 82 has been cut the pusher 44 drives the liner 82 down guide 52 and into the upside down cap 14 as illustrated in FIG. 2H. Pusher 44 then returns through guide 52 and cutter 50 and resumes the initial position illustrated in FIG. 2E. Another cap 14 is then indexed into position along with fresh liner material 34 and the cycle of FIG. 2E–2H is repeated.

The improved liner cutting method just described has several additional important features. First of all, the triangular shape of cutting rim 80 is such that it simultaneously pinches and cuts liner 34 and compresses any dust that might otherwise float into the cap 14 or the machine 10. Secondly, the withdrawing pusher 44 never touches the web 34 because the face 84 of anvil 48 overlaps the cutting rim 80 of the cutter 50. Or, as stated previously, the inside diameter 74 of anvil 48 is smaller than the inside diameter 76 of cutting rim 80. Accordingly, no dust is formed as the pusher 44 withdraws. Thirdly, because the web material is firmly backed up there is no tearing of the material fibers and negligible delamination of the material. Delamination of the cap liner can be a problem because of subsequent delamination of the plug when used by the consumer.

The following is a more detailed description of the structure and function of the invention.

Figure 16:
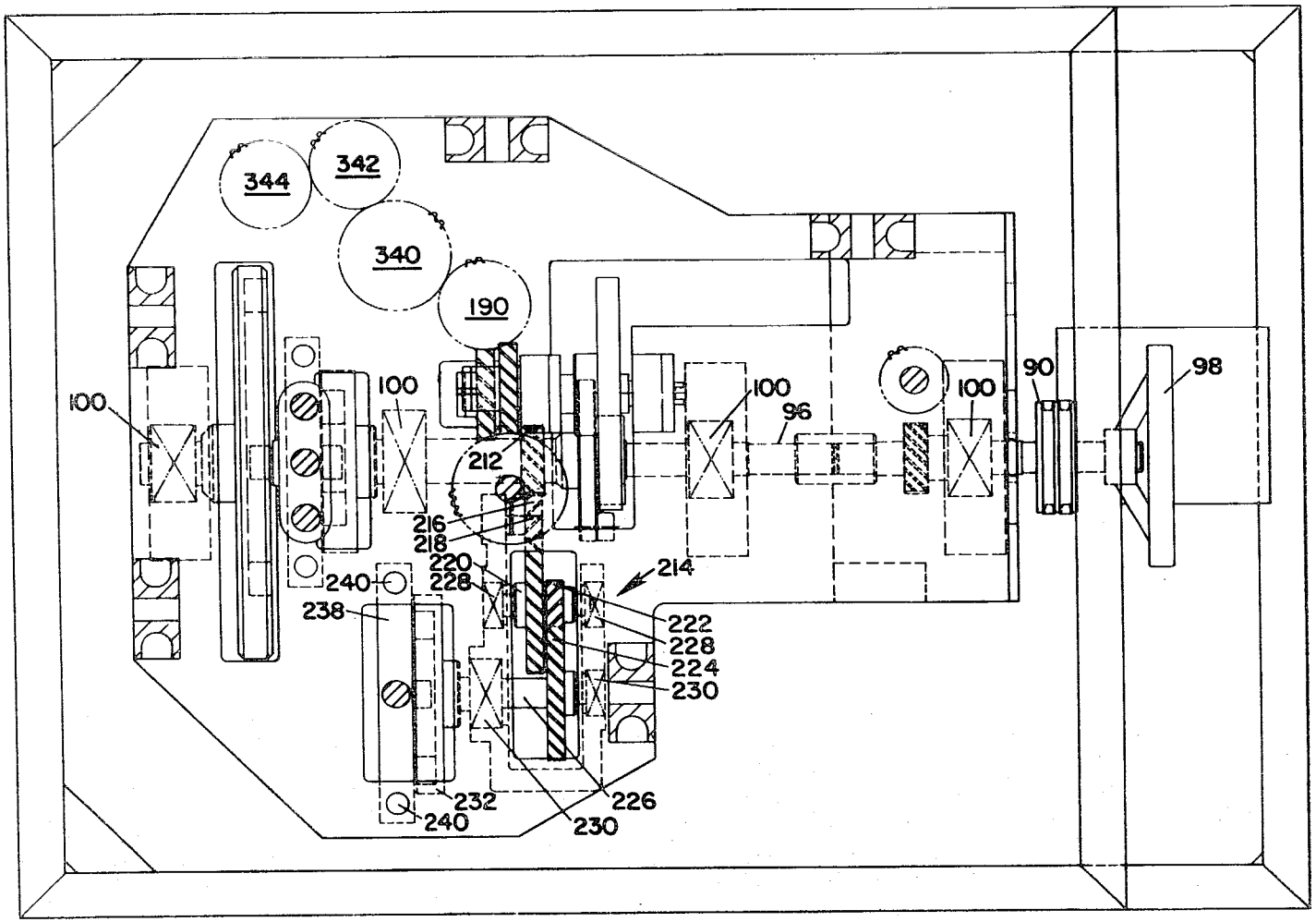
FIG. 16 is a partial cut-away top plan view of the main drive shaft and associated gear trains.
Figure 17:
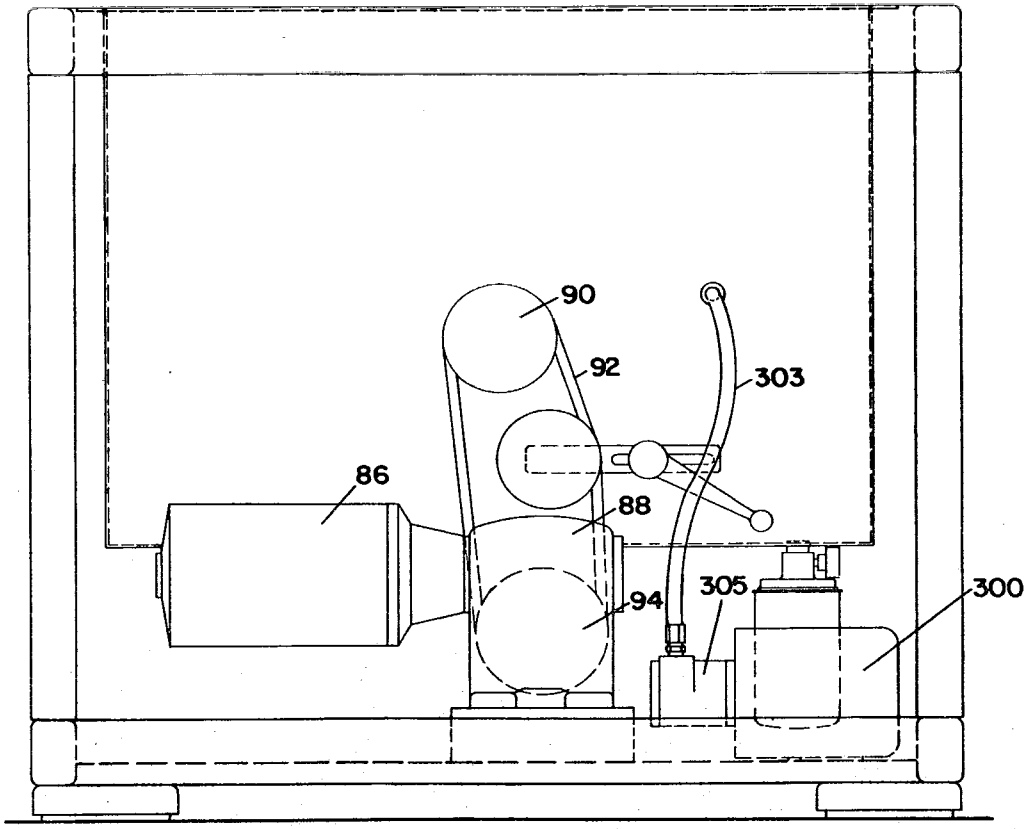
FIG. 17 is a partial side elevational view of the drive motor and gear reduction mechanism.

Power to the machine is provided by a conventional 1½ hp motor 86 which can be seen in FIG. 17. Motor 86 drives a gear reducing mechanism 88 which in turn drives main drive shaft pulley 90 by belt 92 and drive pulley 94. Pulley 90 drives the main shaft 96 which controls all of the important machine elements. A wheel 98 is provided to crank the shaft 96 by hand, if necessary. The relationship of the main drive shaft 96 to the other machine elements may be more fully understood with reference to FIGS. 9 and 16.

Main drive shaft 96 is supported in a conventional manner by bearings 100 located at regular intervals along the shaft. All of the bearings 100 are supported by a bottom plate 102 which stretches across the interior length of the machine cabinet 104.

Figure 9:
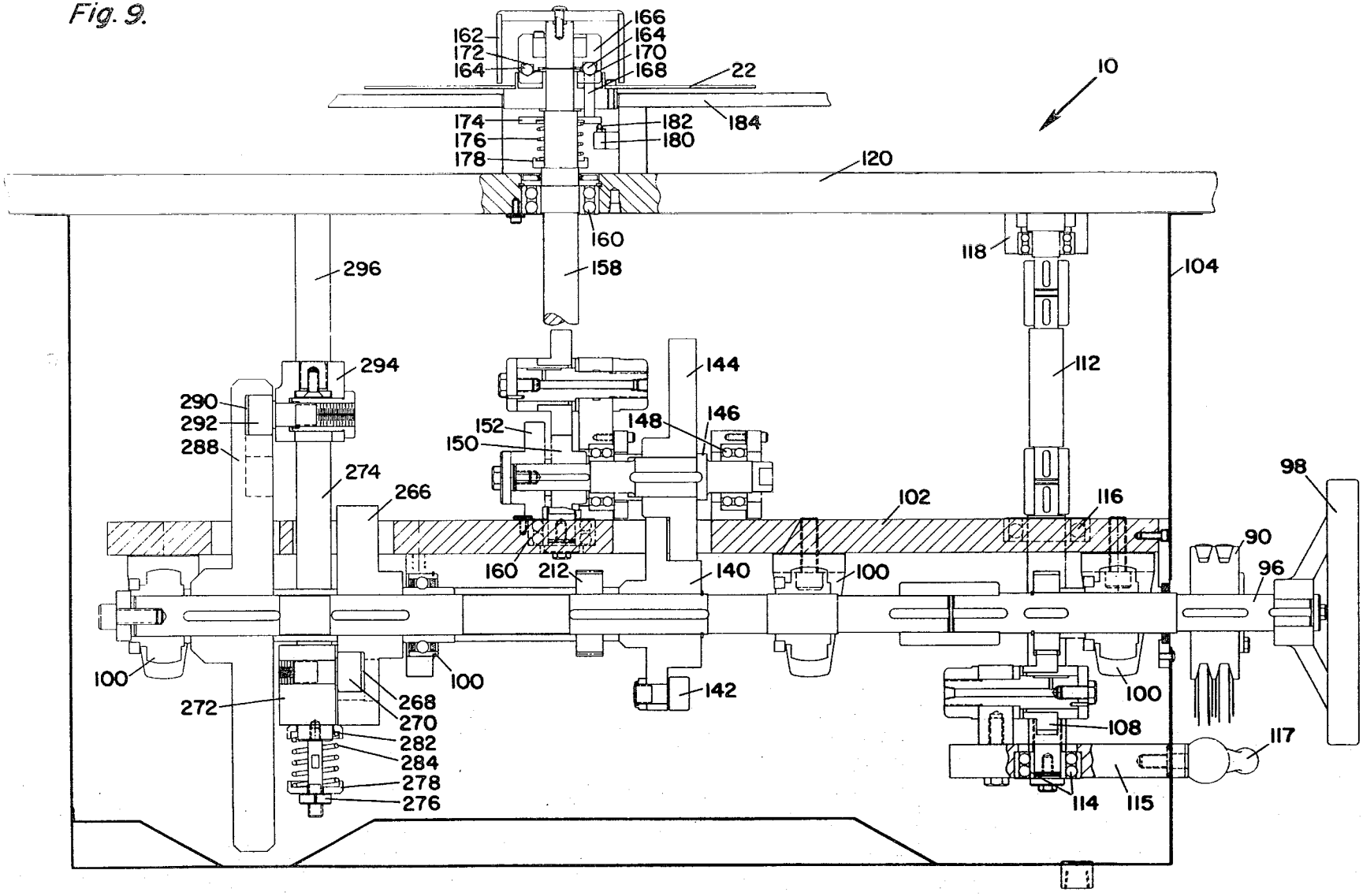
FIG. 9 is a partial cut-away side elevational view of the main drive shaft assembly.
Figure 10:
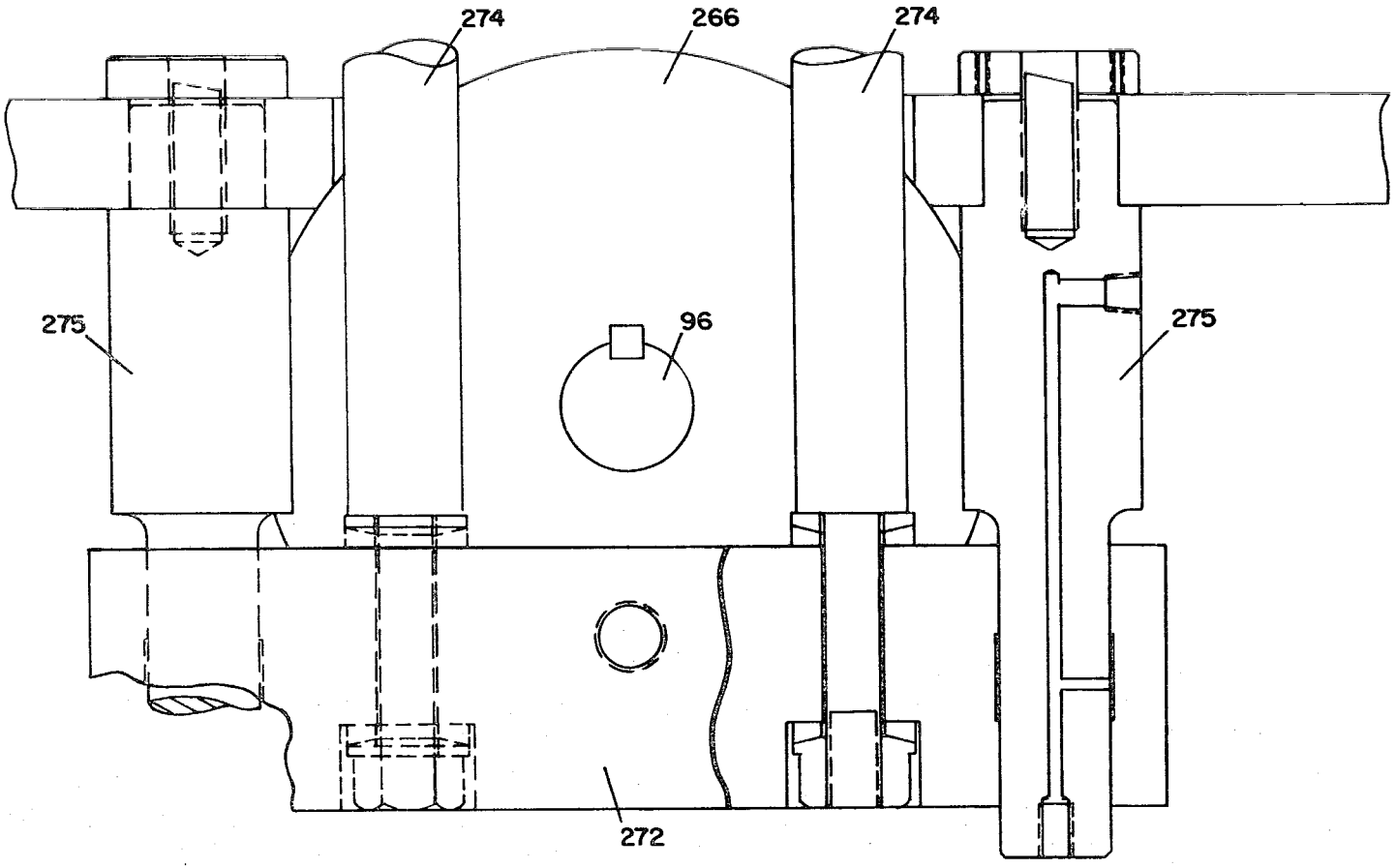
FIG. 10 is a partial cut-away front elevational view of the anvil drive mechanism.
Figure 11:
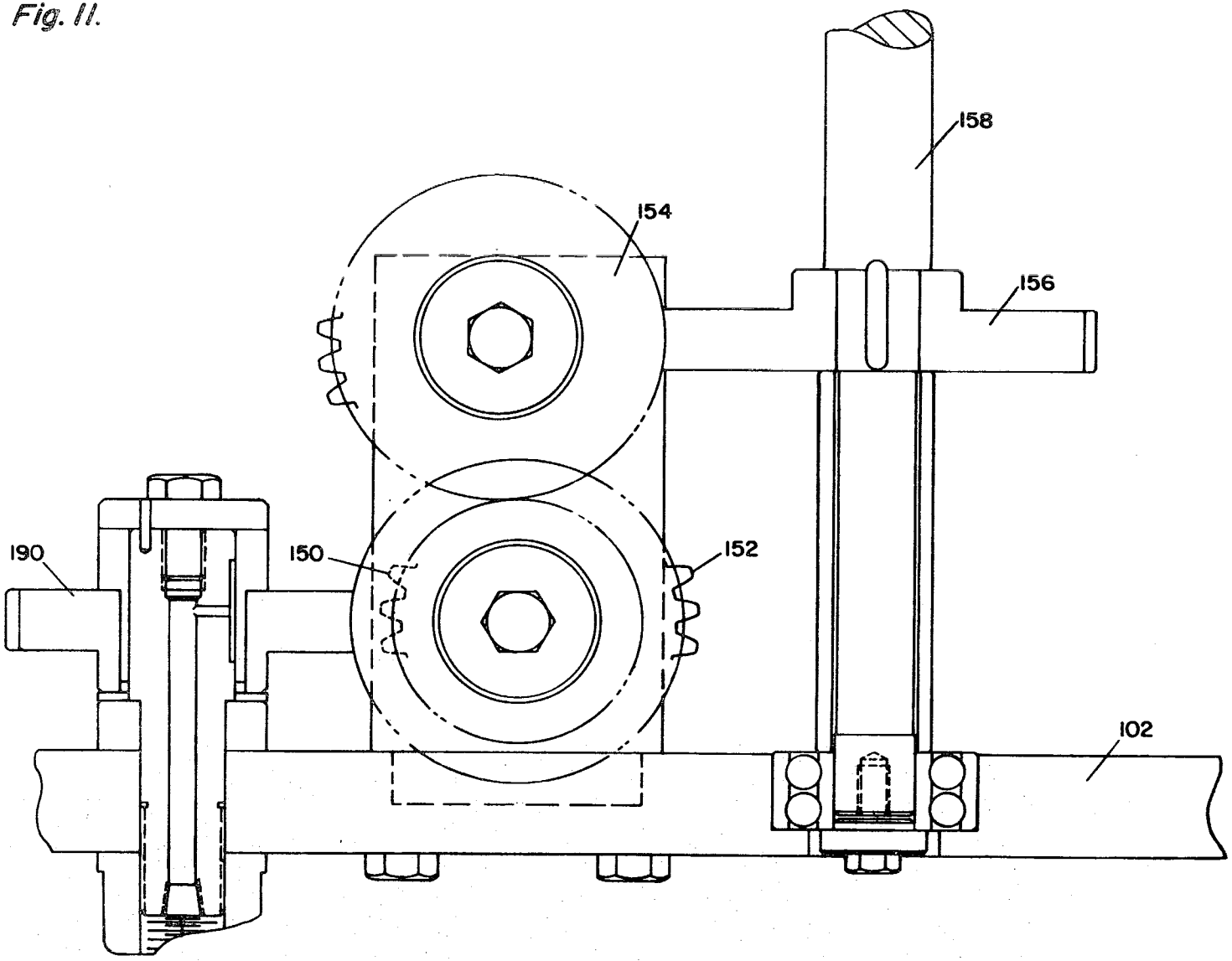
FIG. 11 is a partial cut-away front elevational view of the star wheel drive mechanism.
Figure 12:
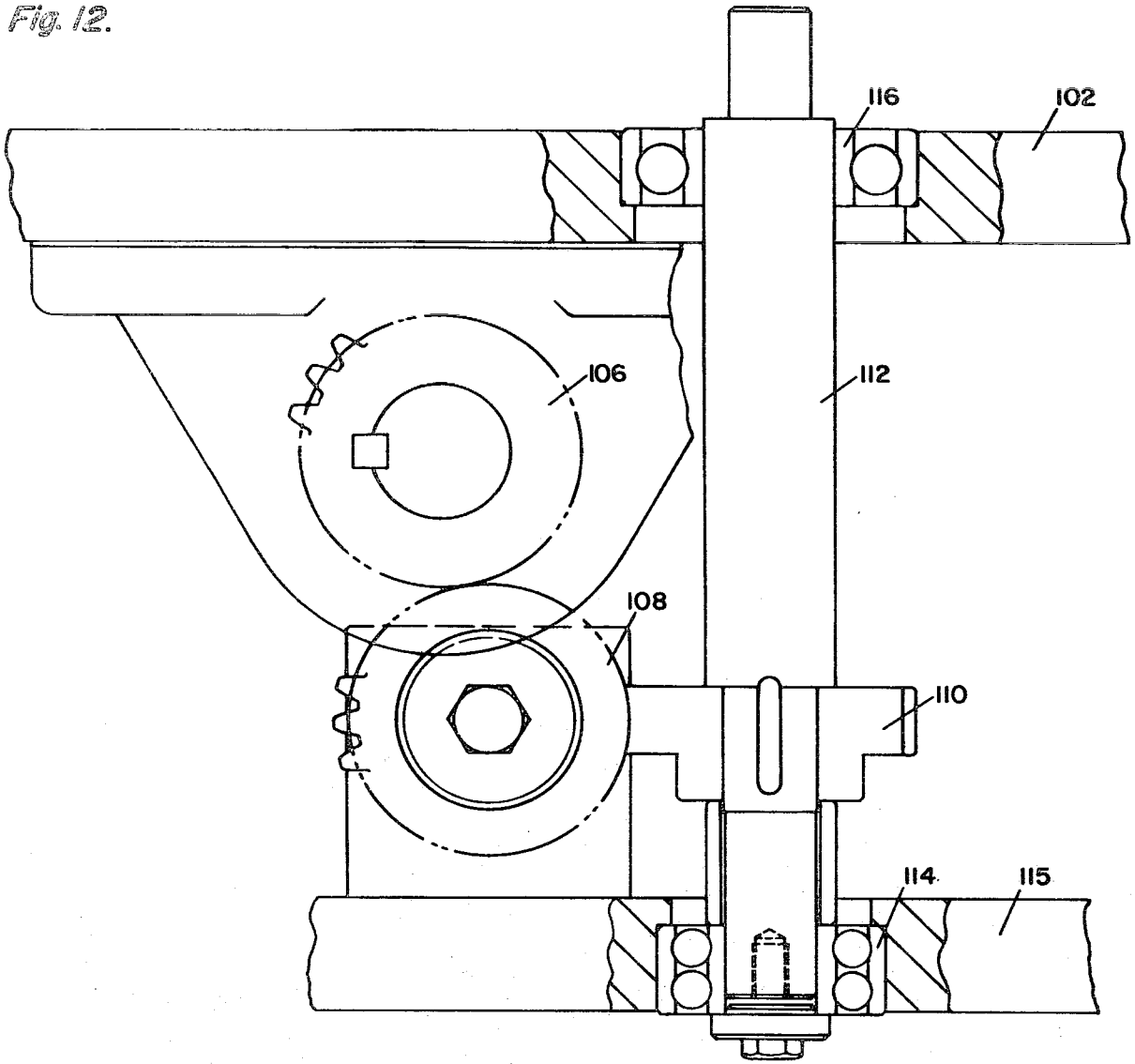
FIG. 12 is a partial cut-away side elevational view of the cap feed drive mechanism.

The positive cap feed mechanism 20 will be described first. As shown in FIGS. 9 and 12 a gear wheel 106 mounted on shaft 96 impinges upon and drives intermediate helical gear 108. The vertical gear 108 in turn drives horizontal gear 110 which is rigidly connected to the cap feed drive shaft 112. The cap feed drive shaft 112 is supported by a ball. bearing 114 at the bottom thereof and by bearing 116 located in bottom plate 102. A bearing 118 supports the shaft 112 as it emerges through the top plate 120 of the machine.

A horizontal drive gear 122 is connected to the top portion of shaft 112 which emerges above top plate 120. Horizontal drive gear 122 in turn impinges upon vertical drive gear 124 which continuously drives cap screw 28 via shaft 126. Shaft 126 is supported in a conventional manner by bearings 128. The cap feed mechanism 20 further includes an override mechanism 130 which comprises a detent plate 132, a detent ball 134 and spring mechanism 136. If screw 28 is jammed the ball 134 will be driven out of the detent pocket 138 and power to the screw 28 will be interrupted until such time as the jam is cleared. This feature is important because it prevents unnecessary damage to the caps and to the machine.

The cap feed screw 28 preferably comprises a metal such as aluminum having an appropriate self-lubricating surface such as Tufram®. Tufram® is a registered trademark of General Magnaplate. Tufram® is a coating which is applied to aluminum and is slippery in nature and is extremely hard. All ride surfaces and contact points of the machine 10 are of this nature.

The web feed mechanism 54 and the star wheel indexing sections are run off the same geneva input drive wheel 140. The periphery of the geneva input drive wheel 140 includes a drive lug 142 which is adapted to engage accommodating slots in the geneva output gear 144 in a manner known to those of ordinary skill in the art. Geneva output 144 is rigidly connected to a shaft 146 which is horizontally supported by a pair of conventional bearings 148. Shaft 146 is rigidly connected to star wheel drive gear 150 and web feed drive gear 152. Star wheel drive gear 150 impinges upon vertical intermediate gear 154 which in turn directly drives horizontal gear 156. Gear 156 is firmly attached to star wheel drive shaft 158. A pair of bearings 160 attached to bottom plate 102 and top plate 120 support shaft 158. By changing the ratio of gears 150 and 156 it is possible to change the angle of index of star wheel 22.

Star wheel 22 is connected to shaft 158 through pins 168 balls 164 and a housing 166 which is positively driven by the shaft 158. Pins 168 includes a head section having a ball receiving detent pocket 170 therein. Pocket 170 is conical in shape. Balls 164 are contained within pockets 172 of drive shaft 166. The lower ends of pins 168 impinge upon a spring loaded plate 174 which is biased in that position by spring 176. The outer end of spring 176 pushes against a fixed plate 178. A conventional limit switch 180 is located directly below spring loaded plate 174 and is arranged to interrupt the electrical circuit of the machine 10 if contact head 182 touches up against plate 174. The star wheel 122 is located up above cap ride plate 184. The cap ride plate 184 provides vertical support to the caps 14 while the star wheel 22 provides the horizontal impetus to those elements.

The star wheel override mechanism operates in the following manner. If a cap 14 jams the star wheel 22 that element will tend to remain in position as the shaft 158 attempts to rotate. As shaft 158 rotates the cap 166 tends to drive ball 164 up the inclined sides of detent pocket 170 thereby camming pin 168 downwardly against plate 174. In turn plate 174 impinges against the contact arm 182 of limit switch 180 which causes the machine to immediately shut down. A cover 162 protects the override mechanism from dust and debris.

Figure 3:
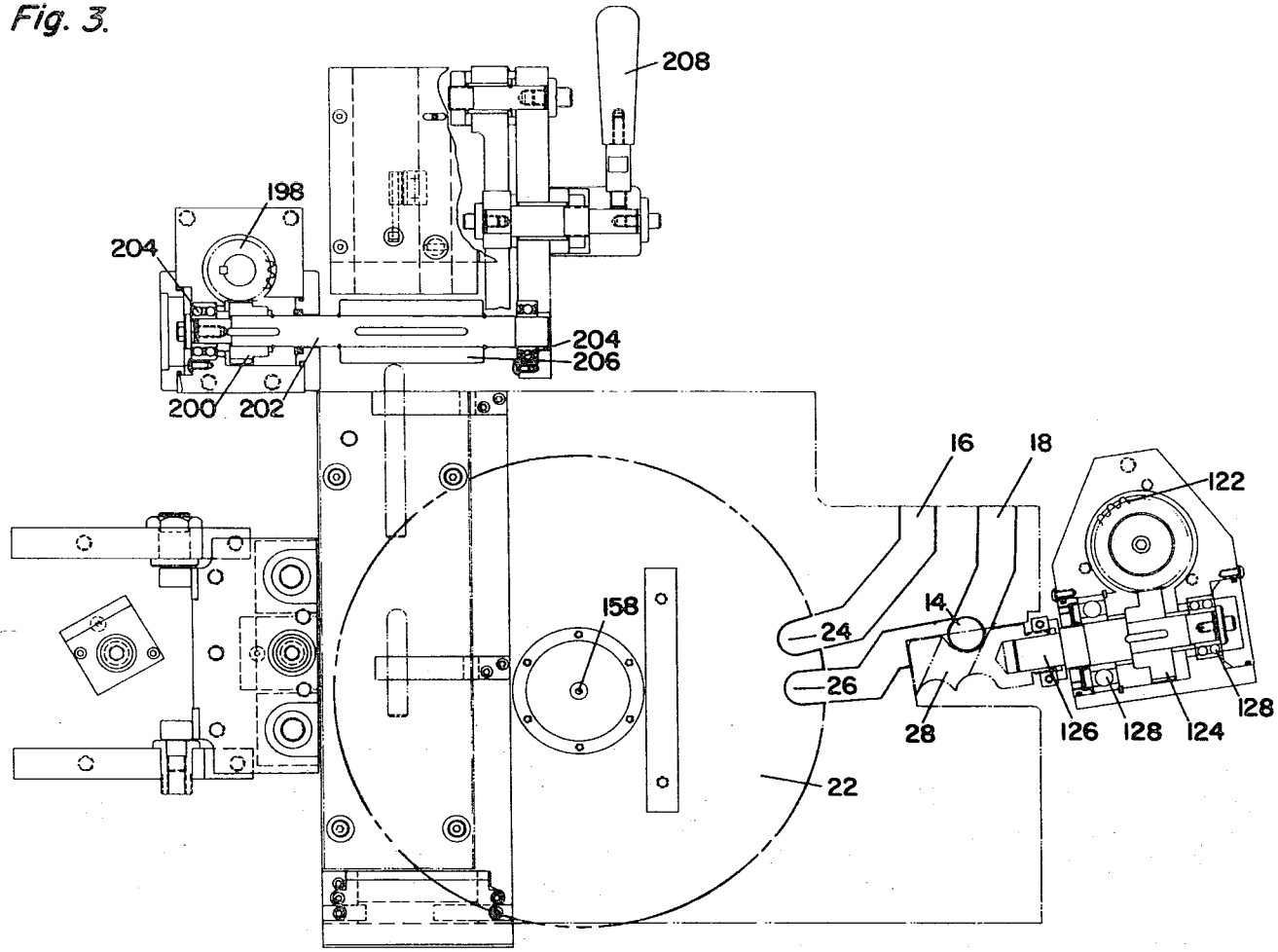
FIG. 3 is a top plan view of the machine.
Figure 7:
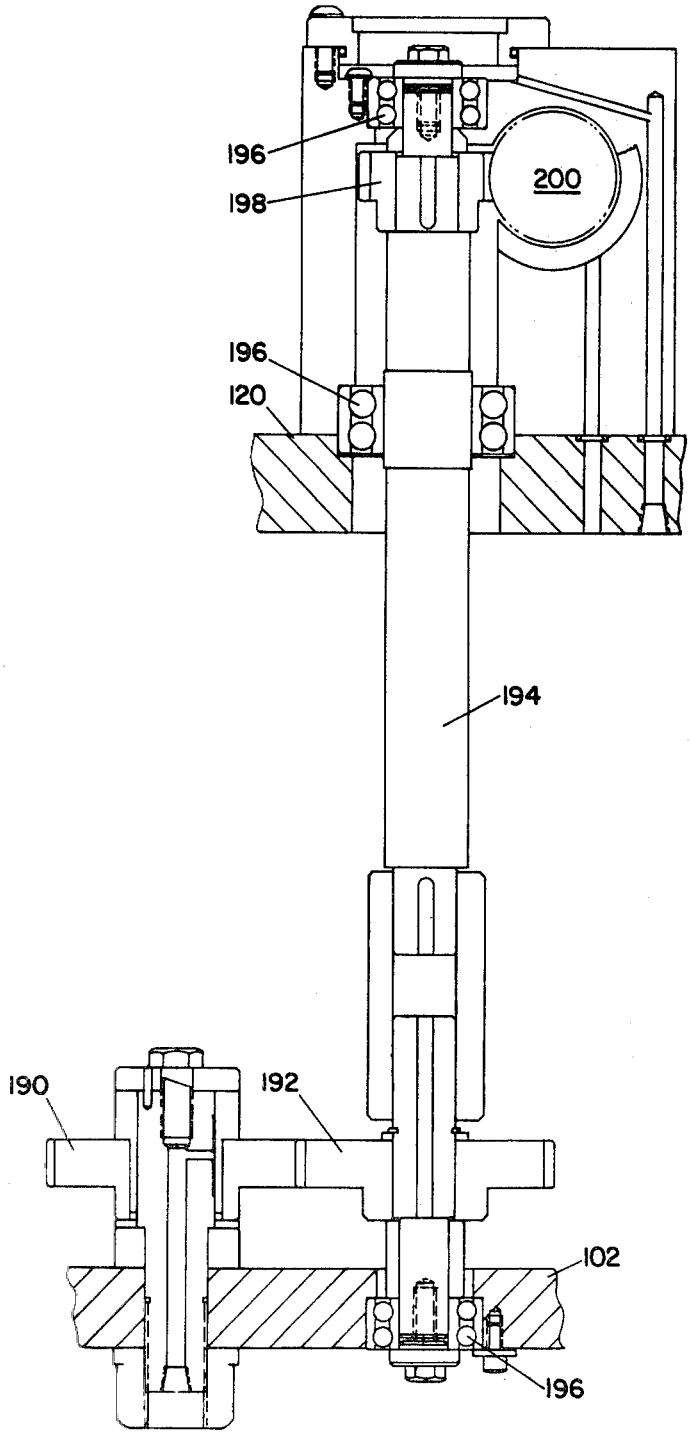
FIG. 7 is a partial cut-away end view of the web feed gear box.
Figure 8:
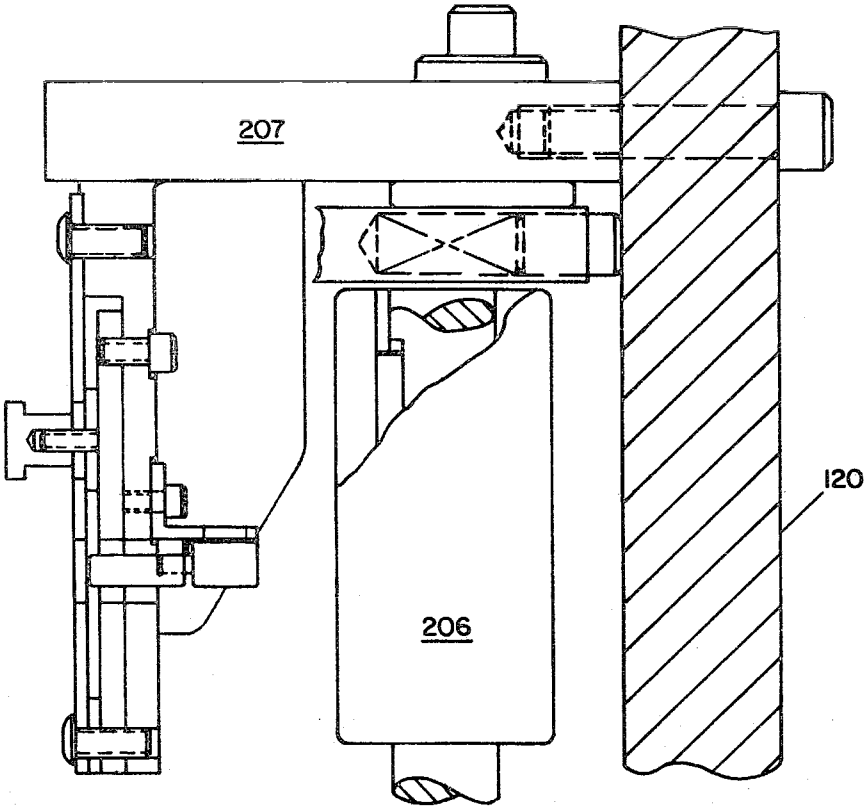
FIG. 8 is a partial cut-away side elevational view of the web feed section.

The web feed mechanism is driven off of gear 152. Vertical gear 152 impinges upon horizontal gear 190. Horizontal gear 190 and vertical gear 152 are 45° helical gears. Details of the web feed mechanism may be more fully understood with reference to FIGS. 7 and 8. As shown in FIG. 7, horizontal gear 190 impinges upon drive gear 192 which is firmly attached to web feed drive shaft 194. The shaft 194 is vertically supported by three sets of bearings 196. Another gear 198 is attached to the top of shaft 194 and drives a vertical right angle gear 200 attached to web drive roller 206. The relationship of those elements will best be understood with reference to FIG. 3. Web drive shaft 202 is supported at both ends thereof by a pair of bearings 204.

Figure 5:
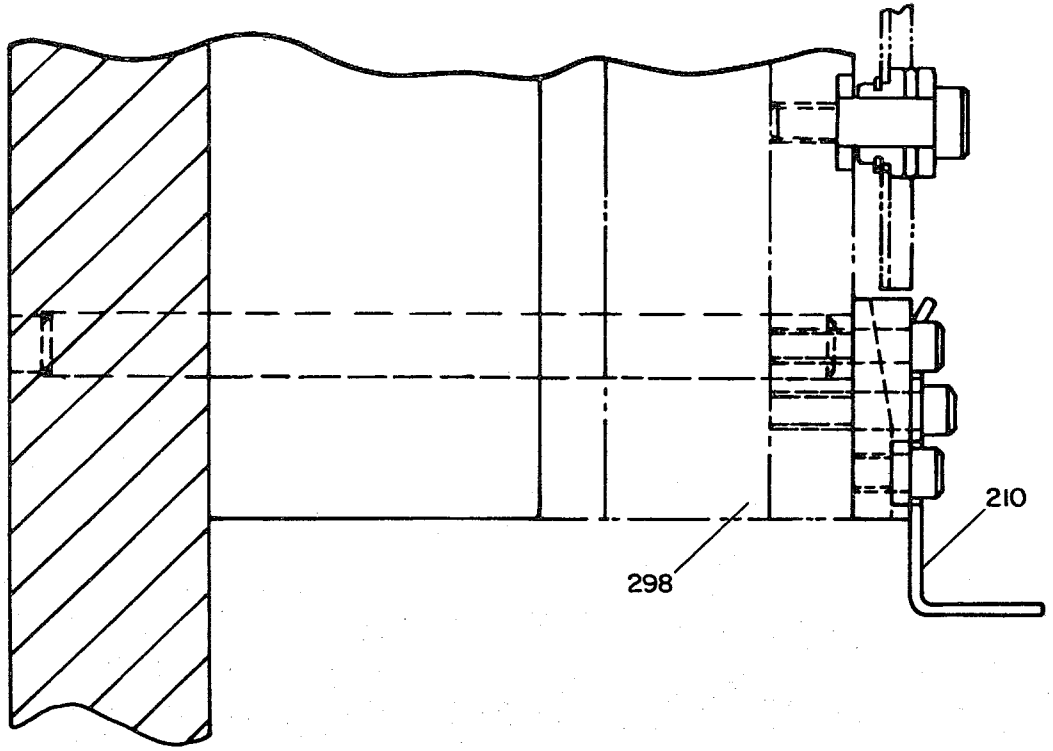
FIG. 5 is a partial cut-away side elevational view of the web guide mechanism.

An adjustable nip roller, not shown, is located above web drive roller 206. The web 34 is pinched between drive roller 206 and the nip roller and drive across the top plate of the machine by the web feed mechanism just described. The tension between the rollers may be adjusted by turning an eccentric stud. Handle 208 is used to release web pressure through a cam attached to the handle shaft. The alignment of web 34 is further controlled by a web guide 210 such as illustrated in FIG. 5.

Figure 13:
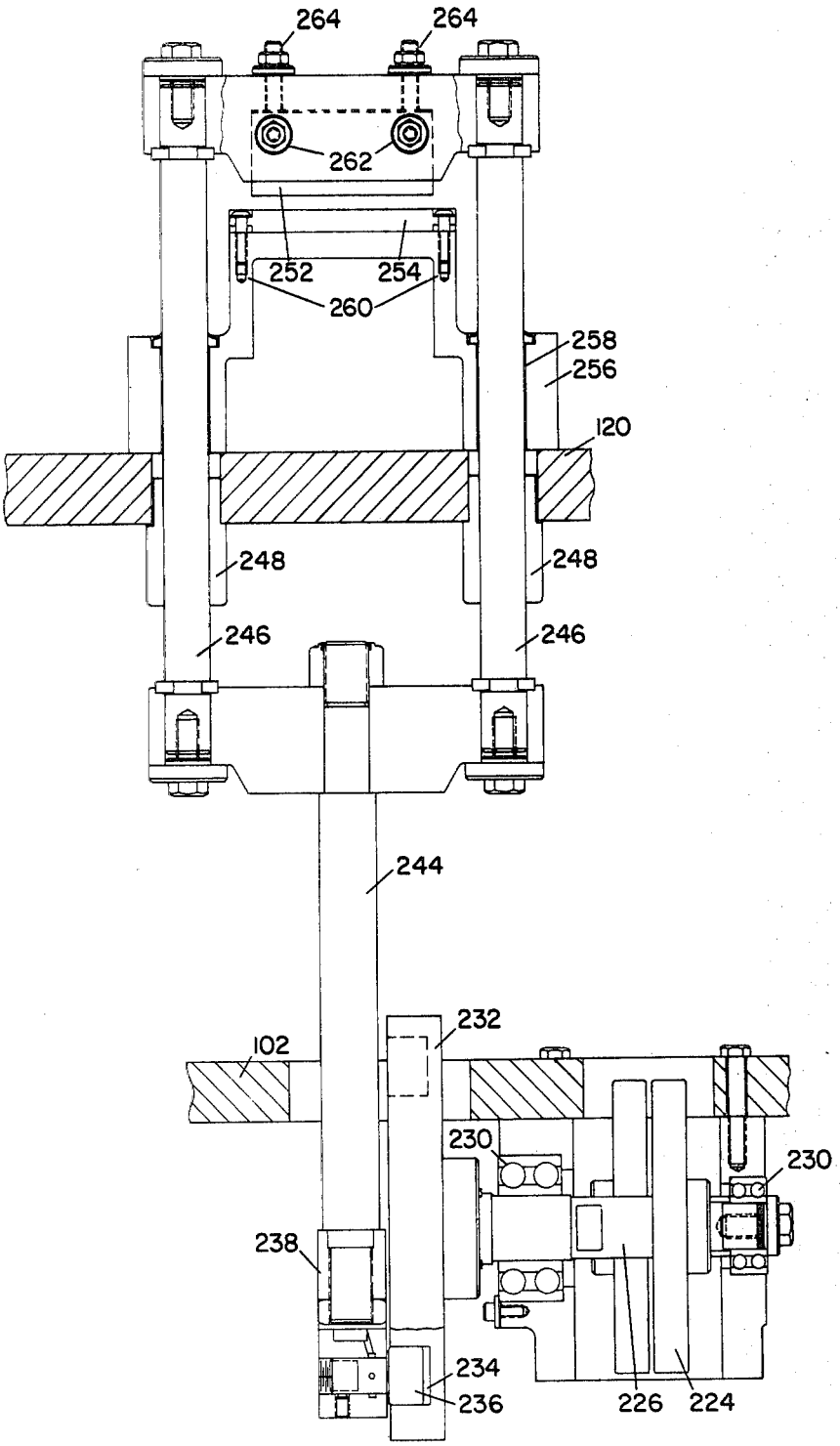
FIG. 13 is a partial cut-away side elevational view of the web cutter and anvil mechanism.
Figure 14:
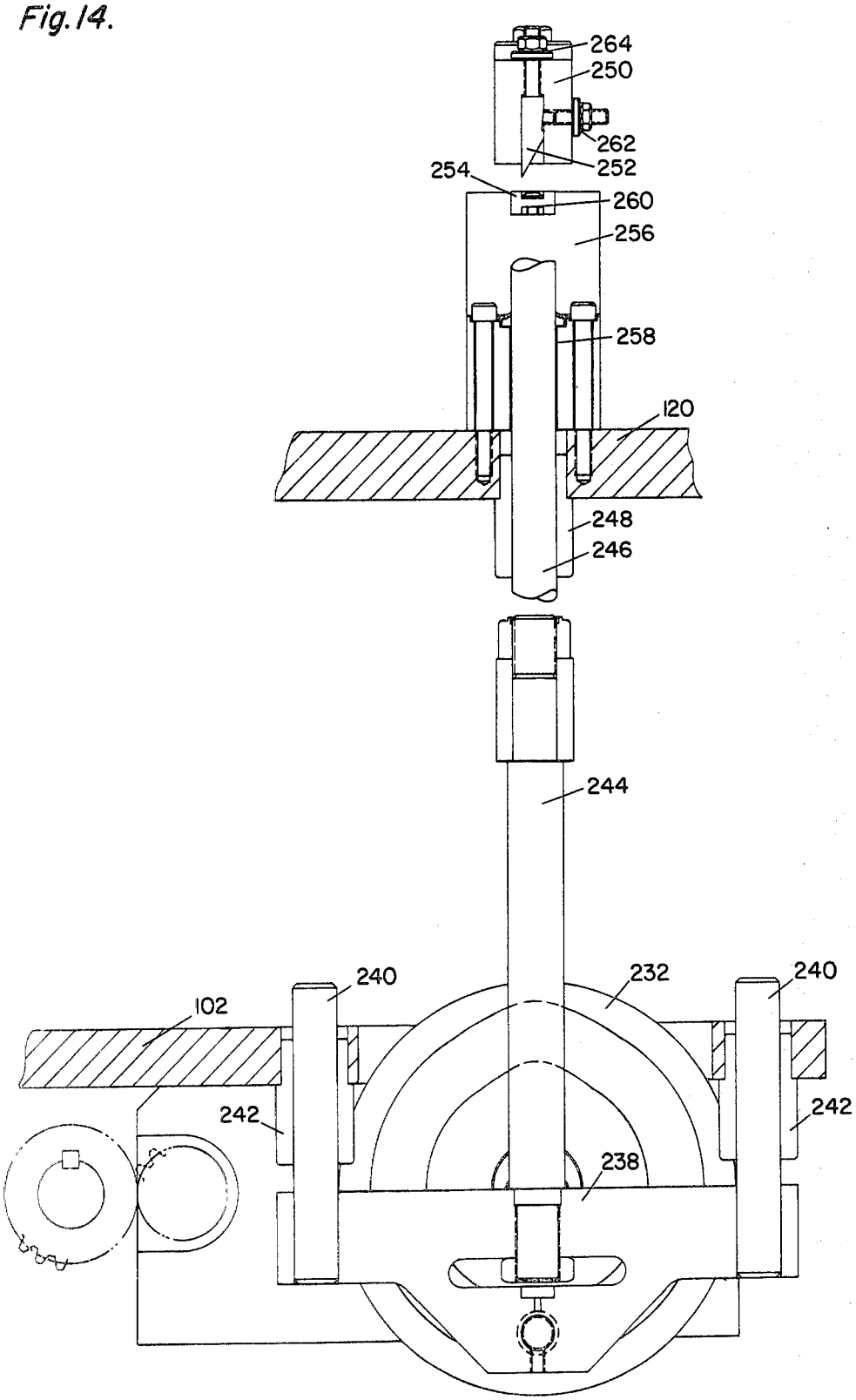
FIG. 14 is a partial cut-away side elevational view of the web cutter and anvil mechanism of FIG. 13.
Figure 15:
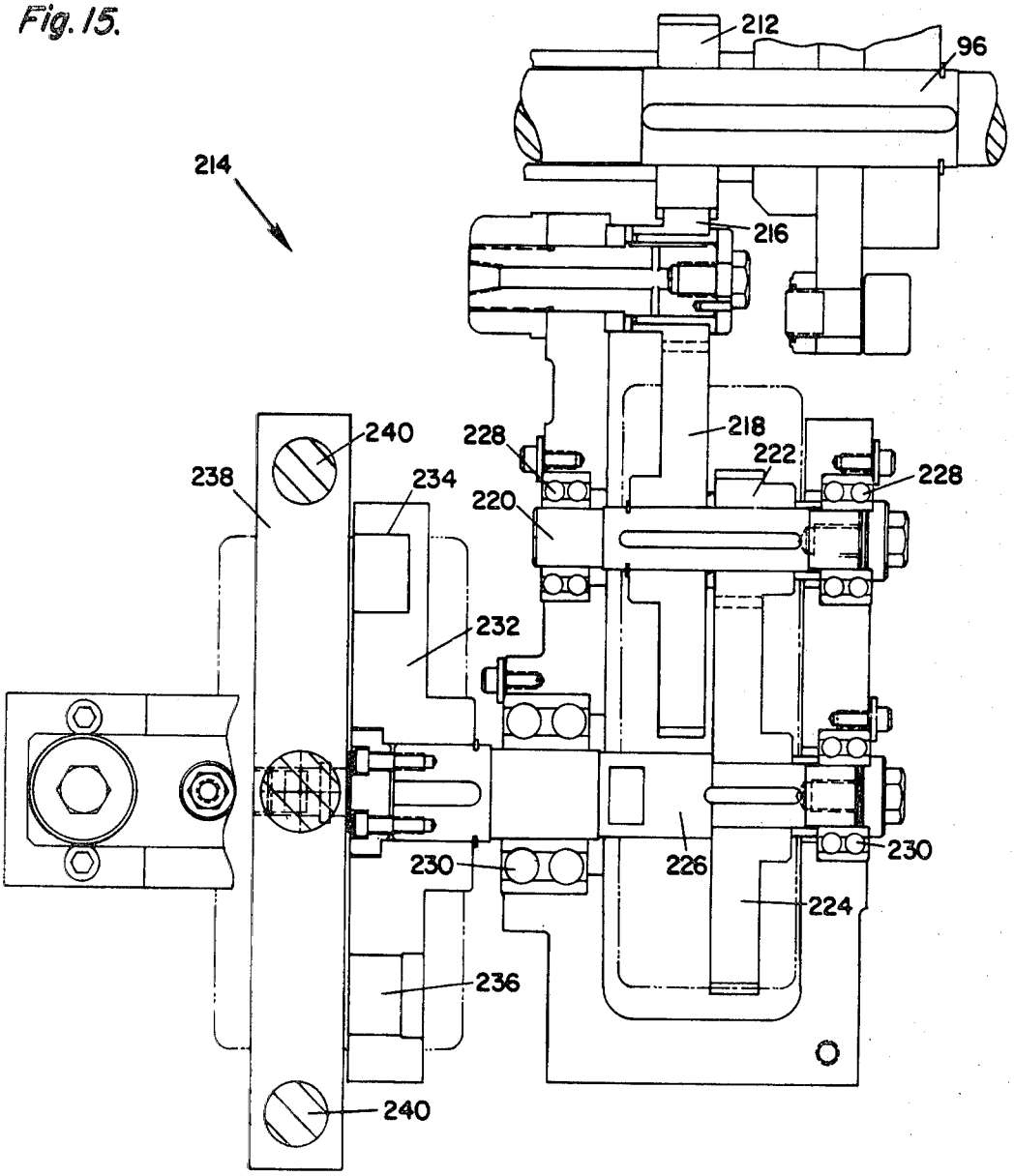
FIG. 15 is a partial cut-away top plan view of the web cutter mechanism and its associated drive train.

The web cut mechanism of FIGS. 13, 14 and 15 receives its power from web cut gear 212 as shown in FIG. 9. This feature may also be clearly understood by referring to FIG. 15. Gear 212 drives a gear reducer unit 214 which causes the web cutter mechanism to make one web cut for every six cycles of the cap lining mechanism. The relationship of the gear reduction train may also be appreciated with reference to FIG. 16. As shown in those figures, drive gear 212 comprises a 3" gear which impinges upon a 2" idler gear 216. The timing of the web cut mechanism may be modified by changing the engagement position of gear 216. Idler gear 216 in turn impinges upon 6" gear 218. Accordingly, a 2 to 1 speed reduction is obtained between drive gear 212 and 6" gear 218. Gear 218 sits upon shaft 220 which coaxially accommodates 2" gear 222. 2" gear 222 in turn drives a 6" gear 224 which is attached to rotatable shaft 226. Accordingly, a 3 to 1 speed reduction is obtained between gears 222 and 224 and a 6 to 1 speed reduction is obtained by the mechanism 214 from drive gear 212 to output gear 224. Shaft 220 is supported by a pair of bearings 228. Similarly, shaft 226 is supported by a pair of bearings 230.

A cam drive plate 232 is rigidly attached to one end of shaft 226 and includes a cam follower path 234 along its face. As shown in FIG. 13 a cam follower lug 236 is attached to follower block 238 and rides within path 234. Block 238 is controlled in its vertical movement by a pair of vertical guide bars 240 which are held in position by a pair of bushings 242 mounted in bottom plate 102. The block is attached to vertical web cutting shaft 244 which is attached at its upper end to a pair of vertically reciprocating rods 246 which pass through the top plate of the machine 120. A pair of bushings 248 are attached to top plate 120 and support the rods 246. The upper end of rods 246 are connected to a cutter blade mounting block 250 which carries with it a long web cutting blade 252. Blade 252 is located directly above an anvil block 254 which is mounted on a casting 256 which rests upon the surface of the machine top plate 120. The anvil mounting bracket 256 includes a pair of passageways 258 which allow the rods 246 to pass through.

Web cutting anvil 254 is releasably mounted to casting 256 by a pair of bolts 260. The cutting blade 252 is held in position in block 250 by a pair of horizontal bolts 262. The vertical positioning of blade 252 is controlled by another pair of bolts 264.

The particular arrangement of the blades 252 with respect to the anvil 254 is relatively important. In FIG. 14 it will be noted that the tip of blade 252 is offset by a bit from the center line of anvil 254. Accordingly, if the anvil 254 wears in a first position it may be rotated sideways 180° to a second position. If the anvil wears in that position then the unit may be flipped upside down 180° to a third position. Finally, if there is wear in the third position the block may be rotated sideways another 180° to a fourth position. Obviously another rotation would take it back to one of its starting positions. Therefore, by mounting the anvil 254 in the manner illustrated it is possible to obtain four times the normal wear associated with such elements by remounting it in any one of four different positions so that the blade 252 is always eccentrically located with respect to the center line of the anvil 254.

The cap liner cutting mechanism is driven by an anvil drive cam 266 which is mounted directly on shaft 96 as illustrated in FIG. 9. Cam 266 includes an interior groove 268 which accommodates a follower lug 270. Lug 270 is directed connected to follower block 272. Block 272 is attached to anvil drive shaft 274. Block 272 is vertically controlled by a pair of guide rods 275 which pass through the block 272. Cup 278 supports the bottom of a spring 284 which impinges against the under side of a cup 282 which rides under block 272. Block 272 only travels about ¼" during its cycle and spring 284 serves to counterbalance oscillatory motion. The upper end of shaft 274 is supported by a bushing 284 mounted in top plate 120. The anvil mounting bracket 46 is firmly attached to the top of shaft 274 in the manner shown with regard to FIG. 6. The cap lining anvil 48 is mounted to bracket 46 by threaded elements 286.

Pusher rod 44 receives its power from circular cam 288 which is mounted directly to the far end of drive shaft 96. Pusher cam 288 includes a circular groove 290 which receives roller lug 292. Roller lug 292 is attached directly to pusher drive block 294. A relatively unique feature of the invention is the fact that the pusher drive block 294 uses the anvil drive shaft 274 as vertical guides. Accordingly, anvil drive shaft 274 pass through the pusher drive block element 294. In operation the anvil may have a total travel in the neighborhood of a ¼" whereas the pusher rod may travel as much as 2" or 3" during the same cycle. The pusher follower block 294 is directly connected to pusher shaft 296 which is terminated at the top thereof by a pusher mounting plate 38, previously described. Pusher mounting plate 38 carries with it pusher housing 40, pusher override spring 42 and the pusher element 44. The precise relationship between the pusher 44, the anvil 48 and the score cutter 50 has been previously described in detail with respect to FIGS. 2E–2H. Each machine 10 includes two cap lining stations which operate simultaneously. As seen in FIG. 1, both stations are offset slightly so that the web 34 is cut in a staggered manner. A web guide plate 298 is used to keep the web in relative alignment.

Figure 18:
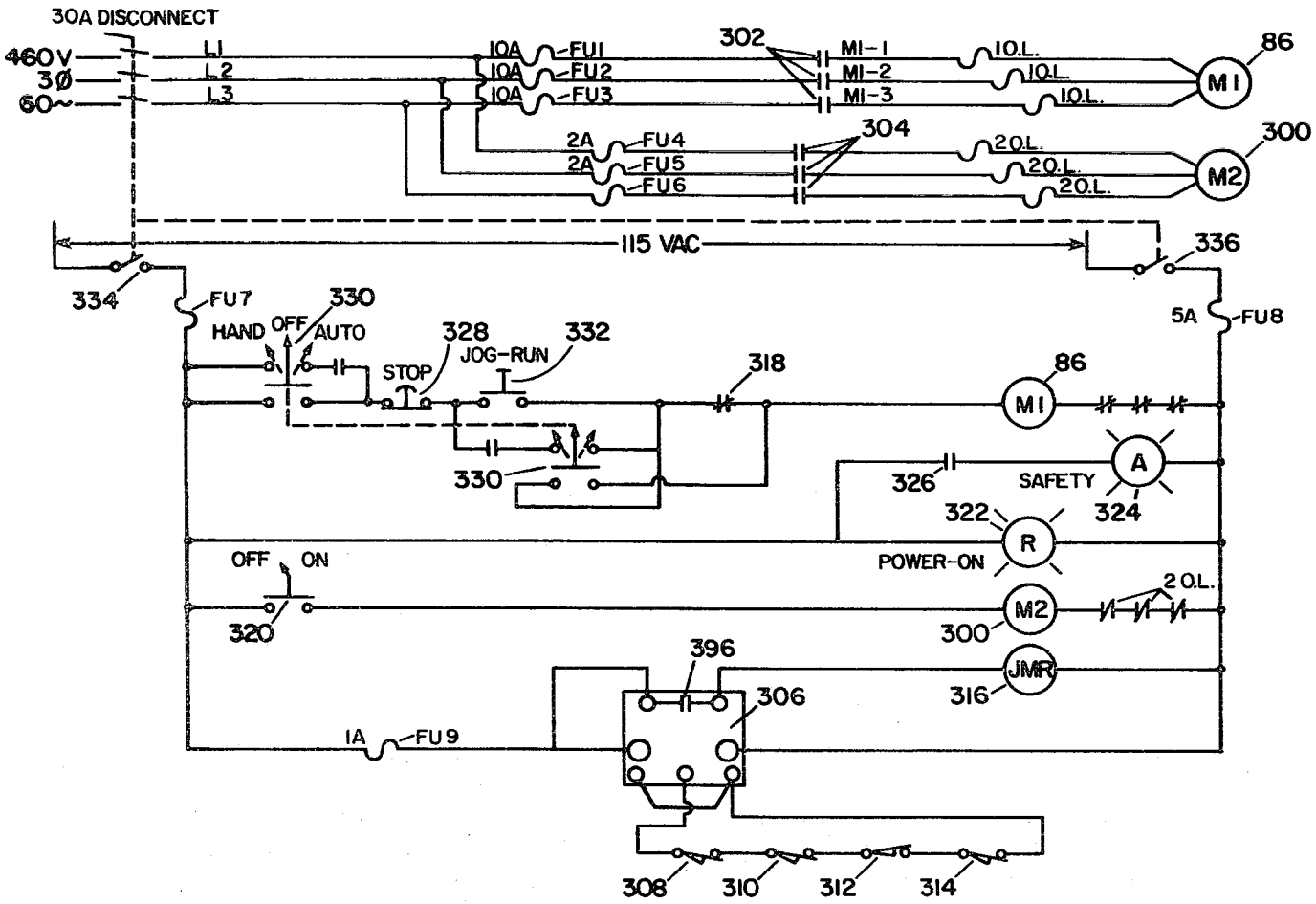
FIG. 18 is a complete schematic illustrating the interrelationship of the electrical components which control the invention.

The electrical operation of the device is relatively straightforward and can be understood with reference to the schematic in FIG. 18. Drive motor 86 is connected to a source of 460 volts 3 phase, 60 cycle current. In a similar manner a ⅓ hp pump motor 300 continuously provides automatic lubrication to all of the important moving elements. Motor 86 is connected to its power source via three interrupt contacts 302. Similarly, the pump motor 300 is connected to the same source through three other interrupt contacts 304. The electrical circuit includes a fail safe feature so that the motor M1 automatically turns off if the machine jams or a door is open, or if the web breaks or runs out. The fail safe feature includes a solid state relay 306 and four limit switches 308, 310, 312 and 314 connected in series across terminals 2 and 3 of solid state relay 306. Solid state relay 306 preferably comprises a Regent Solid State Relay Model SR 510 V10 made by Regent Controls, Inc. of Stamford, Conn. 06902. Limit switches 308 and 310 are mounted adjacent to the lefthand and righthand doors of the cabinet respectively. Both are normally open switches which are closed only when there respective cabinet doors are closed. Limit switch 312 corresponds directly to limit switch 180 which is normally closed and will detect a jam in the star wheel 22. Limit switch 314 is a normally open switch which will close if there is a jam in the web feed mechanism. Solid state relay 306 receives its input power directly from a 115 volt high voltage source and will internally produce a low output voltage which can drive a standard output relay 316. The contacts 318 of relay 316 are directly across motor 86. Accordingly, if one of the four limit switches 308, 310, 312 or 314 is open the contact 318 will open and the motor 86 will shut down for lack of power. Pump motor 300 is adapted to run continuously and is controlled by off and on switch 320. A red light 322 indicates when power is applied to the machine. An amber safety light 324 will also go on if the machine jams. That is to say if one of the four limit switches, 308, 310, 312 or 314 is open. Amber light 324 is controlled by a second set of relay contacts 326 associated with output relay 316. A safety override stop switch 328 may be used to directly control the power to motor 86. A three way double pole, triple throw switch 330 can be used to select between three modes of operation. The first mode is the "off" mode in which no power is supplied to motor 86. The second mode is the "automatic" mode in which power is continuously supplied to motor 86 unless one of the four limit switches is open. The third mode is the "hand" operated mode in which the motor 86 can be advanced intermittently by activation of the jog-run button 332. If necessary, power to the be interrupted by disconnecting the circuit through a first auxilliary switch 334 or a second auxilliary switch 336.

There are several important advantages associated with the present invention. Those advantages include: A. A novel and relatively dust-free means for producing cap liners. This is especially important in the cosmetic industry where dust in products, such as shampoo may have an adverse effect on the ultimate consumer; B. The use of a dual feed mechanism in which one feed path is positively driven so as to increase machine speed and reliability; C. A spring-loaded mechanism on the insertion pusher to prevent machine damage from the crushing of inverted caps; D. An override ball/pin/plate/limit switch combination on the star wheel; E. A unique web cutting apparatus which operates only after six cycles of the cap liner cutting mechanism thereby reducing the total amount of dust generated by the operation. Because the cap liner cuts are staggered in a zigzag pattern, the web liner 34 is in fact cut in a variable fashion from 3½ pitches to 10½ cap pitches; F. The device is modifiable in a variety of ways to accommodate different size caps 14 and liner webs 34. For example, it is possible to adjust the timing of the web cut apparatus by changing the phasing of idler gear 216. Similarly, the web feed mechanism is driven by a train of four gears 190, 340, 342 and 344 is illustrated in FIG. 16. By changing the relative ratios of the gears in a manner known to those of ordinary skill in the art it is possible to modify the speed of the web feed mechanism 54. The speed of the web feed mechanism 54 may also be changed by changing the size of the web feed roll. The star wheel 22 has to be changed to accept caps 14 of different sizes. It will accept a cap up to 1¾" in outside diameter; G. In order to further minimize the dust problem internal portions of the machine are enclosed in a housing which comprises in a large part acrylic panels which keep the dust and debris out, but which allow a trained machine operator to observe the inner workings of the machine; H. The machine is entirely self-lubricating. Motor 300 continuously provides power to a lubrication pump attached by lines 303 to all of the critical moving interfaces; I. A major advantage of the device is that all major elements are directly and positively driven by a single drive shaft 96 through a series of gear trains or track style cams. This approach has been found to be highly reliable and tends to keep the timing of the moving elements relatively constant with respect to each other; J. The machine is especially adapted to operate under the exacting conditions required by the cosmetic and pharmacological industry. Those industries require machines that are flexible so as to accommodate a wide variety of product lines and sizes. Typically the liners are formed from foam, rubber, polystyrene or wax or plastic coated cardboard materials. The liners are typically employed to fit inside receivable plastic caps. The end product has to be aesthetically pleasing and relatively dust free. The machine just described is highly flexible and reliable and especially adapted for the cosmetic and pharmacological industry.

Given the foregoing teaching there are certain minor changes that could be made to the machine. For example it is not strictly necessary to cut the web 34 after every six cutting cycles. Rather a slightly longer or shorter interval may be selected according to the liner material used.

While the invention has been described with reference to the preferred embodiment thereof, it will be appreciated by those of ordinary skill in the art that changes may be made to the structure and function of the parts without departing from the spirit and scope of the invention.

We claim:

1. A cap lining apparatus for cutting a cap liner from a web of lining material and placing said cap liner in a cap, said apparatus comprising:

a hollow anvil means;

a hollow score cutting means for cutting said web, said anvil means and said score cutting means being lined up coaxially so that the hollow portions of said anvil means and said score cutting means form a cavity;

web feed means for transporting said web between said anvil means and said score cutting means;

anvil drive means for driving said anvil means against said score cutting means;

pusher means for pushing said cap liner into said cap, said pusher means being located in the cavity formed by said anvil means and said score cutting means, said cavity being large enough to allow said pusher means to reciprocate therein;

a rotatable means for holding said caps, said rotatable means including a plurality of cap receiving pockets therein;

indexing means for indexing said rotatable means; and, feed means for presenting at least two caps to a first and second receiving pocket respectively between successive indexing rotations of said rotatable means, said feed means further including a first feed means for gravity feeding a first cap to a first receiving pocket and a second feed means for positively and directly feeding a second cap to a second receiving pocket.

2. The apparatus of claim 1 wherein said second feed means includes a worm screw means.

3. The apparatus of claim 2 wherein said second feed means includes an override means which prevents said second feed means from jamming if a cap is incorrectly lodged in said second feed means.

4. The apparatus of claim 3 further including:

an override means in said pusher means to prevent a cap from being crushed if said cap is accidentally inverted when presented to said pusher means.

5. The apparatus of claim 4 wherein said override means for said pusher means comprises a spring.

6. The apparatus of claim 5 further including an override means in said rotatable means for preventing damage to said apparatus if a cap is incorrectly lodged in a receiving pocket.

7. The apparatus of claim 6 wherein said override means for said rotatable means comprises:

a cap means;

at least one ball means housed within said cap;

a pin means having an indentation therein for receiving said ball means, said pin means being attached to said rotatable plate and movable in response to pressure exerted by said cap on said ball means;

a pressure activated plate means which contacts said pin means; and, a limit switch means responsive to the movement of said pressure activated plate.

8. The apparatus of claim 7 further including:

a web cutting means for cutting said web no more than once for every two cap liners cut by said apparatus.

9. The apparatus of claim 8 wherein said web cutting means cuts said web after twelve cap liners have been cut.

10. The apparatus of claim 9 further including:

automatic lubricating means for lubricating the contacting moving portions of said apparatus.

11. The apparatus of claim 10 further including:

close means for enclosing the drive means of said apparatus to prevent dust and debris from clogging said drive means.

* * * * *